US007237613B2

(12) United States Patent
Radi et al.

(10) Patent No.: US 7,237,613 B2
(45) Date of Patent: Jul. 3, 2007

(54) UNDERBALANCED MARINE DRILLING RISER

(75) Inventors: Amin Radi, Nassau Bay, TX (US); Thomas A. Fraser, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 361 days.

(21) Appl. No.: 10/900,598

(22) Filed: Jul. 28, 2004

(65) Prior Publication Data

US 2006/0021755 A1 Feb. 2, 2006

(51) Int. Cl.
*E21B 29/12* (2006.01)

(52) U.S. Cl. ..... 166/359; 166/358; 175/5

(58) Field of Classification Search ..... 166/358, 166/359, 367; 175/5–10
See application file for complete search history.

(56) References Cited

U.S. PATENT DOCUMENTS 4,059,148 A 11/1977 Blomsma
4,216,834 A 8/1980 Wardlaw
5,220,961 A * 6/1993 Guesnon et al. ..... 166/367
5,533,574 A * 7/1996 Gonzalez ..... 166/358
5,797,452 A * 8/1998 Martin ..... 166/110
5,868,437 A * 2/1999 Teague ..... 285/45
6,035,938 A * 3/2000 Watkins ..... 166/345
6,148,922 A * 11/2000 Vatne ..... 166/367
6,273,193 B1 * 8/2001 Hermann et al. ..... 166/359
6,354,372 B1 * 3/2002 Carisella et al. ..... 166/118
6,457,529 B2 * 10/2002 Calder et al. ..... 166/368
6,470,975 B1 * 10/2002 Bourgoyne et al. ..... 175/57
6,913,092 B2 * 7/2005 Bourgoyne et al. ..... 175/7
6,983,957 B2 * 1/2006 Bettinger ..... 285/302

* cited by examiner

*Primary Examiner*—Thomas A Beach
(74) *Attorney, Agent, or Firm*—Bracewell & Giuliani LLP

(57) ABSTRACT

A riser assembly for offshore drilling has an inner conduit suspended within an outer riser. A seal assembly seals an annular space between the inner conduit and the riser at the lower end of the inner conduit. The seal assembly has a pressure area that is independent of the inner conduit, so that any forces acting on the assembly due to pressure in the annulus below the seal assembly pass through the assembly to the riser and not to the inner conduit.

19 Claims, 3 Drawing Sheets

UNDERBALANCED MARINE DRILLING RISER

FIELD OF THE INVENTION

This invention relates in general to offshore drilling, and in particular to a assembly that enables underbalanced drilling.

BACKGROUND OF THE INVENTION

When drilling a well, the operator attaches a drill bit to the lower end of a string of drill pipe and rotates the drill bit, typically by rotating the drill string. The operator pumps drilling fluid down the drill pipe, which exits nozzles of the drill bit. The drilling fluid, along with cuttings, flows back up the annular space surrounding the string. The operator filters the cuttings from the drilling fluid and pumps the cleansed drilling fluid back down the drill pipe in continuous circulation.

The drilling fluid in most wells is weighted with a density that provides a hydrostatic pressure greater than the expected pressure of the earth formation being drilled. Making the drilling fluid hydrostatic pressure greater than the formation pressure reduces the chance of a blowout. In a blowout, the formation pressure exceeds the hydrostatic pressure of the drilling fluid and pushes the drilling fluid out of the hole, sometimes even with the drill pipe.

In some wells, the use of heavy drilling fluids causes excessive amounts of the drilling fluid to enter into the formation. Not only is the drilling fluid lost, but damage to the formation can occur. In another technique, called "underbalanced drilling", the drilling fluid density is light enough so that the hydrostatic pressure at any point along the open hole portion of the well is less than the formation pressure. A rotating blowout preventer seals the upper end of the drill pipe to prevent a blowout. The rotating blowout preventer provides a seal even when the drill pipe is rotating. Underbalanced drilling avoids damage to the formation due to heavy drilling fluid.

To applicants' knowledge, underbalanced drilling has not been utilized in offshore drilling operations. In a typical offshore drilling operation, the operator will extend a drilling riser assembly from a wellhead housing at the sea floor to the drilling platform. The drilling riser assembly includes a subsea blowout preventer that connects to the wellhead housing. During conventional drilling, the drill string is lowered through the riser into the well. The drilling fluid is pumped from the drill pipe and returns up the drilling riser to a diverter at the drilling platform. The diverter diverts the circulating drilling fluid over to the filter equipment for removing cuttings. The diverter also has a blowout preventer that may be operated when the drill pipe is stationary in the event of an emergency.

The drilling riser is a large diameter string of pipe made up of sections that are secured together, typically by flanged connections. A conventional drilling riser possibly may not have a pressure rating adequate to withstand the higher pressure that would occur if the drilling fluid were significantly underbalanced.

SUMMARY OF THE INVENTION

In this invention, an offshore drilling riser is equipped to enable underbalanced drilling operations. The operator secures upper and lower subs into the drilling riser, the lower sub being above the subsea blowout preventer and the upper sub being near the drilling platform. Each sub has a landing profile.

The operator lowers an inner conduit or riser into the drilling riser. The inner conduit may comprise conventional casing of a type that is normally used to case a well. The inner conduit has a sub assembly on its lower end that lands on the landing profile in the riser. The lower sub assembly preferably comprises a seal sleeve that is slidably carried relative to the inner conduit. The seal sleeve lands on the riser landing profile, but the inner conduit continues to move downward until the upper sub of the inner conduit lands on the upper internal profile in the riser. The seal sleeve at the lower sub seals between the riser and the inner conduit. A packoff seals between the inner conduit and the riser at the upper end.

The seals at the upper and lower ends of the inner conduit result in a sealed annulus between the inner conduit and the drilling riser, thereby isolating the drilling riser from internal pressure in the inner conduit. The seal sleeve has a pressure area that is independent of the pressure acting on the inner conduit. That is, the pressure acting from below on the seal sleeve will exert an upward force that bypasses the inner conduit and passes from the seal sleeve directly to the drilling riser.

DETAILED DESCRIPTION OF THE INVENTION

Figure 1:
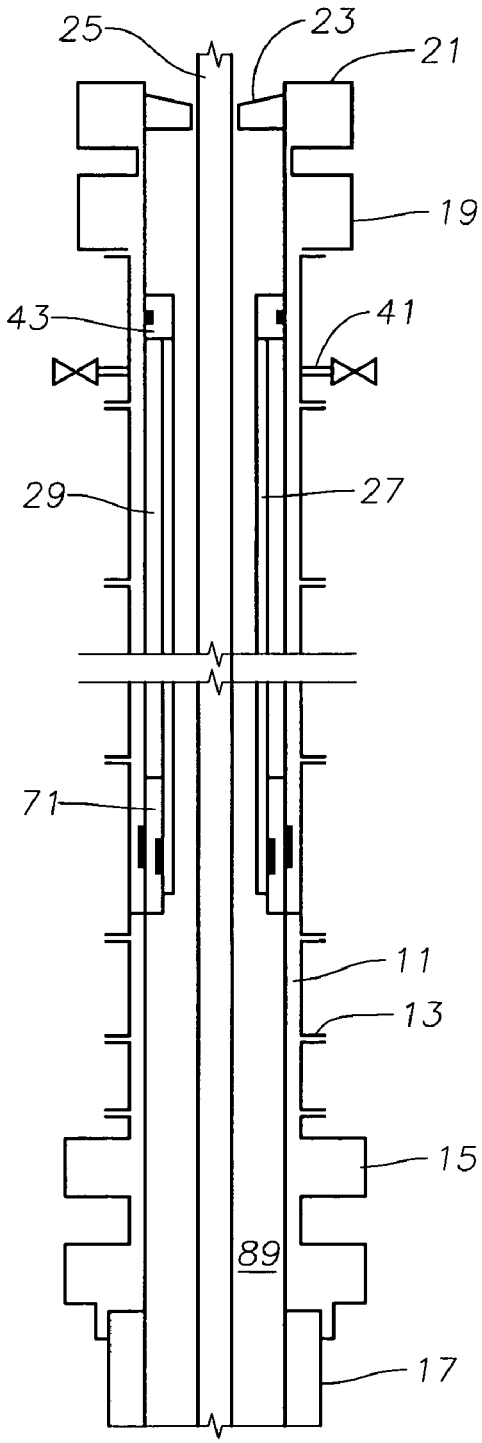
FIG. 1 is a schematic view of an offshore drilling riser assembly constructed in accordance with this invention.

Referring to FIG. 1, the riser assembly includes an outer riser 11 made up of sections of riser pipe secured together. In this embodiment, the various pipe sections are secured together by flanges 13 and bolts (not shown). Outer riser 11 preferably includes a subsea blowout preventer ("BOP") 15 at its lower end. BOP 15 is conventional and secures to a high pressure wellhead housing 17 located at the sea floor.

For underbalanced drilling, a surface blowout preventer ("BOP")19 is preferably located at the upper end of outer riser 11, and a rotating blowout preventer ("BOP") 21 locates above surface BOP 19. Rotating BOP 21 has a seal element 23 that seals around a string of drill pipe 25 and rotates with drill pipe 25. Surface BOP 19 will also seal around drill pipe 25 while drill pipe 25 is stationary in the event that rotating BOP 21 leaks.

An inner riser or conduit 27 is concentrically located within outer riser 11. Inner riser 27 is preferably made up of sections of conventional casing, each section having threaded ends that secure together. The outer diameter of inner riser 27 is spaced radially inward from the inner diameter of outer riser 11, creating an annular space 29. As indicated in FIG. 1, annular space 29 is closed at the top and bottom of inner riser 27 to isolate pressure within inner riser 27 from the portion of outer riser 11 surrounding inner riser 27.

Figure 2:
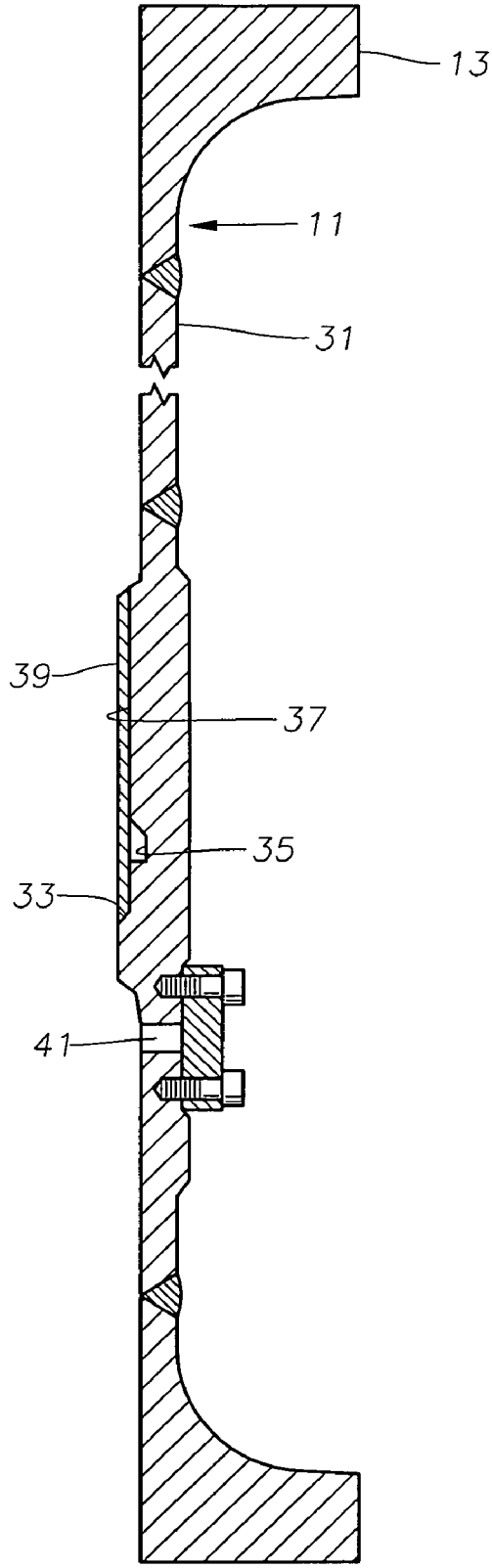
FIG. 2 is an enlarged sectional view of an upper sub in the outer riser of the drilling riser assembly of FIG. 1.

Referring to FIG. 2, an upper sub 31 is secured into and becomes part of outer riser 11. Upper sub 31 has flanges 13 at its upper and lower ends for connection into outer riser 11. Upper sub 31 has an internal upper landing shoulder 33 that faces upward. A lock groove 35 is preferably located a short distance above upper landing shoulder 33. A cylindrical seal surface 37 extends upward from lock groove 35 in this embodiment. Preferably a protective sleeve or wear bushing 39 initially fits over seal surface 37 to prevent damage while outer riser 11 is being used conventionally and before inner riser 27 (FIG. 1) is run. Alternatively, upper sub 31 may be laid-up on deck and not used until just prior to running inner riser 27. In such an operating sequence, since no drilling operation is carried out through upper sub 31, use of wear bushing 39 is not required. Additionally, upper sub 31 may have a monitoring port 41 that communicates with annular space 29 (FIG. 1) to enable the operator to monitor whether any pressure might exist.

Figure 3:
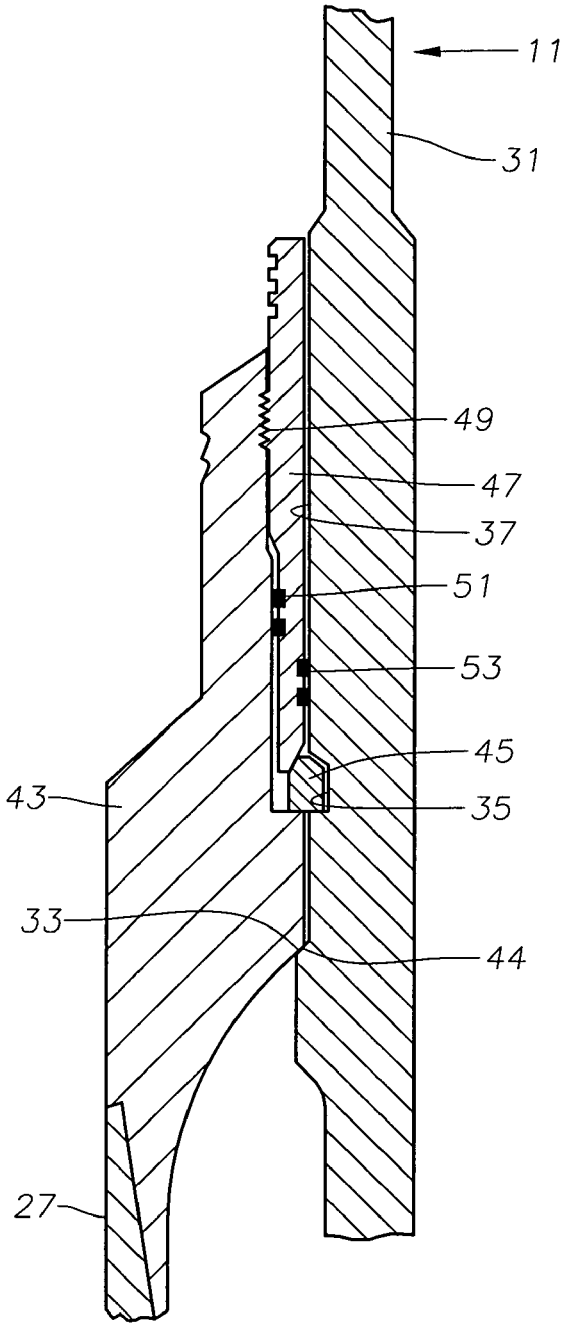
FIG. 3 is an enlarged sectional view of a portion of the upper sub of FIG. 2, showing an upper end of an inner conduit landing in the upper sub.

Referring to FIG. 3, the operator removes wear bushing 39 in a conventional manner before running inner riser 27. A casing hanger 43 secures to and becomes part of inner riser 27. Casing hanger 43 is of a type that typically lands within a subsea wellhead housing, such as wellhead housing 17 in FIG. 1, to support a string of casing. Casing hanger 43 has a downward facing shoulder 44 that lands on upper landing shoulder 33. In the preferred embodiment, casing hanger 43 carries a split lock ring 45 that is pushed out into engagement with groove 35 of upper sub 31. Lock ring 45 prevents any upward movement of inner riser 27.

A packoff 47 has a lower end that contacts lock ring 45 and pushes it from a retracted position (not shown) outward into groove 35. In this embodiment, packoff 47 is a ratchetable type that engages wickers 49 in order to lock seal assembly 47 to casing hanger 43. Packoff 47 has inner and outer seals 51, 53 that seal between casing hanger 43 and the inner diameter of upper sub 31. Many other types of packoffs could be utilized rather than the one shown, including a packoff energized by rotation rather than by straight axial movement. Packoff 47 could be carried by the running tool (not shown) that runs casing hanger 43 or installed by a separate tool.

Figure 4:
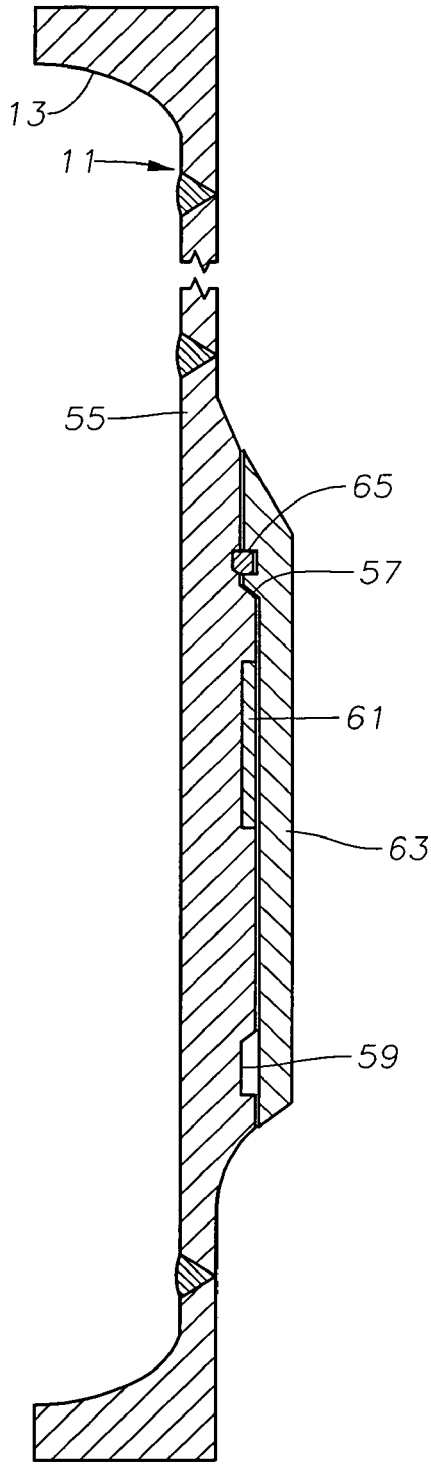
FIG. 4 is an enlarged sectional view of a lower sub of the outer riser of the drilling riser assembly of FIG. 1, shown with a wear bushing installed.

Referring to FIG. 4, a lower sub 55 is connected into and becomes part of outer riser 11 (FIG. 1) a selected distance above subsea BOP 15 (FIG. 1). Lower sub 55 also has flanges 13 for connection into the string of outer riser 11 (FIG. 1). Lower sub 55 has an internal landing shoulder 57. A seal surface or inlay 61 is formed on the inner diameter of lower sub 55. In this example, seal inlay 61 is below landing shoulder 57, but it could be configured above. Also, seal inlay 61 could be a smooth surface formed in lower sub 55, rather than an inlay of sealing material. Lower sub 55 also has an internal lock groove 59 that is annular and in this example located below seal inlay 61. Preferably a wear bushing 63 locates over seal inlay 61 for conventional drilling operations until inner riser 27 (FIG. 1) is run. Wear bushing 63 is shown secured by a retainer ring 65 that is releasable to enable wear bushing 63 to be conventionally retrieved.

Figure 5:
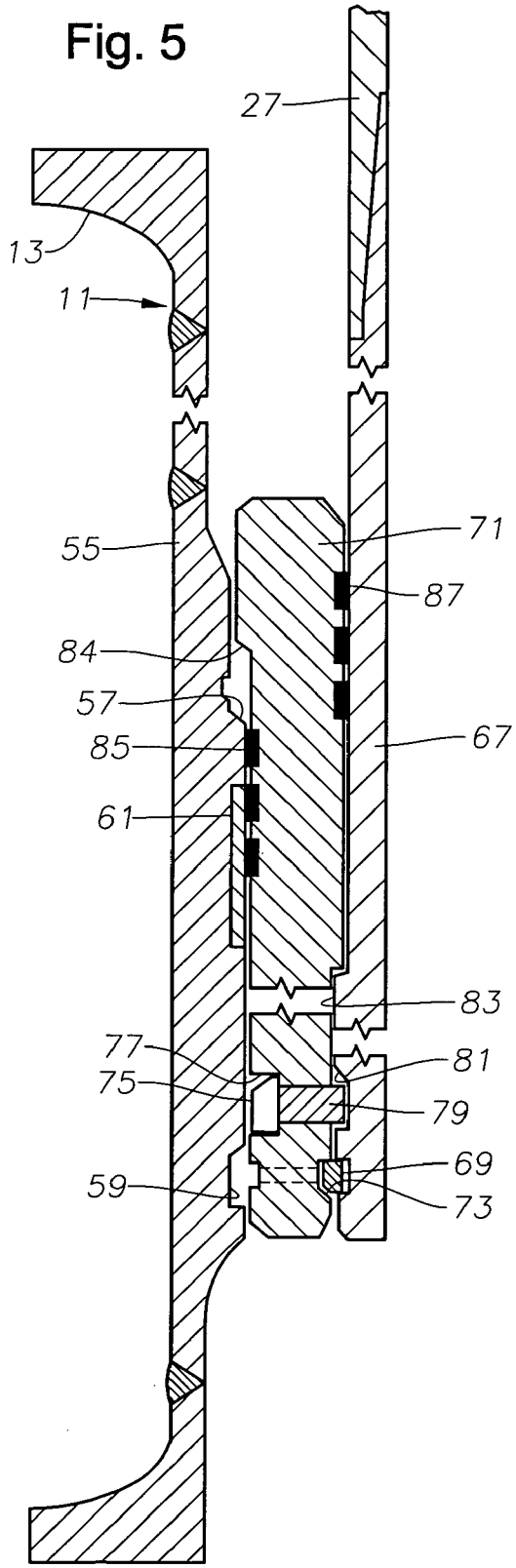
FIG. 5 is a sectional view of the lower sub of FIG. 4, with the wear bushing removed and a lower seal assembly of the inner conduit nearing its landed position.

Referring to FIG. 5, wear bushing 63 (FIG. 4) has been retrieved for installing inner riser 27. A tubular inner body 67 is secured to the lower end of and becomes part of inner riser 27. Inner body 67 has a detent retaining ring 69 located on its outer diameter near the lower end. Retaining ring 69 is a split ring that supports a seal sleeve 71. Seal sleeve 71 is a solid annular member with an internal groove 73 that receives retaining ring 69 while in its first position during the running-in procedure.

Figure 6:
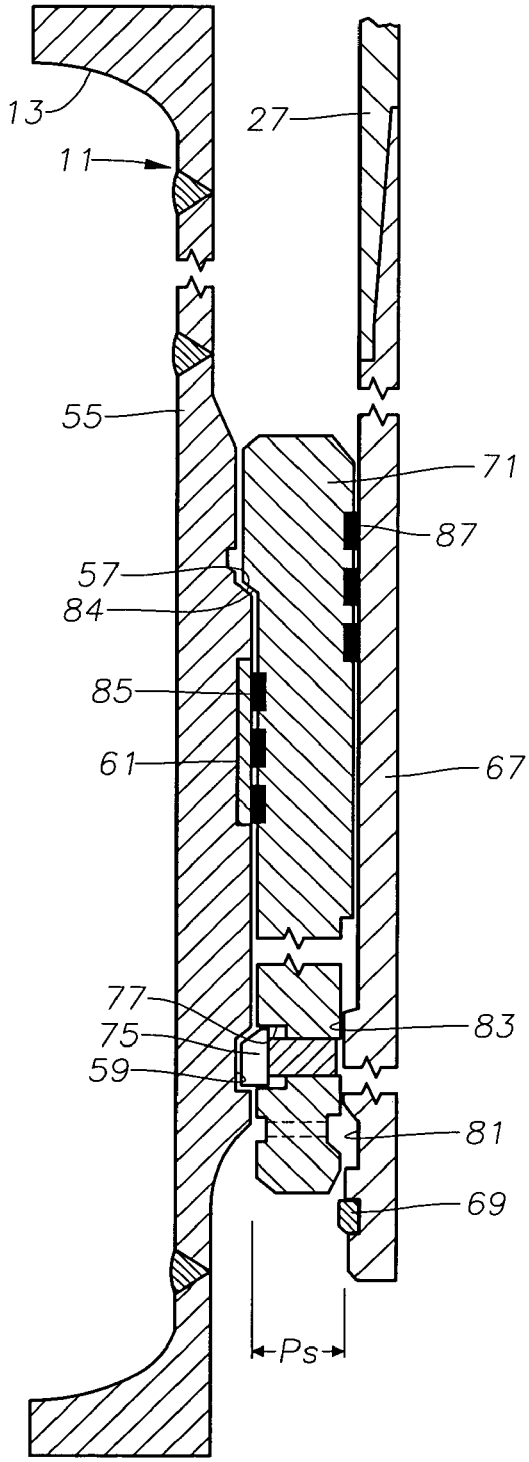
FIG. 6 is a sectional view of the lower sub of FIG. 5, showing the lower seal assembly in its landed position.

A lock ring 75 is secured within an annular recess 77 on the outer diameter of seal sleeve 71. Lock ring 75 is a split ring that will move from the retracted position shown in FIG. 5 to the radially extended position shown in FIG. 6. In the radially extended position, lock ring 75 enters lock groove 59 of outer riser lower sub 55. Moving lock ring 75 from a retracted to an extended position can be handled in a variety of ways. In this embodiment, a plurality of pins 79 (only one shown) extend radially through holes in seal sleeve 71. Each pin 79 has an outer end that abuts the inner diameter of lock ring 75. The natural inward bias of lock ring 75 causes pins 79 to assume the radial inward position shown in FIG. 5 during the running-in procedure. In the running-in position, pins 79 are located within a recess 81 on the outer diameter of inner body 67. Moving inner body 67 downward relative to pins 79 causes a cam surface 83 formed on the outer diameter of inner body 67 to push pins 79 radially outward. Seal sleeve 71 has a downward facing shoulder 84 that lands on shoulder 57. Shoulder 57 is positioned so that when shoulder 84 lands on shoulder 57, lock ring 75 will be in radial alignment with groove 59. Downward movement of inner body 67 causes cam 83 to push lock pins 79 outward and push lock ring 75 into groove 59, as shown in FIG. 6.

Seal sleeve 71 has one or more outer seals 85 that are positioned to engage seal inlay 61. Seal sleeve 71 also has one or more inner seals 87 that engage the outer diameter of inner body 67.

In a typical operation from a drilling vessel, outer riser 11 will be equipped with lower sub 55. For conventional drilling, wear bushing 63 (FIG. 4) will be located within lower sub 55. When the operator wishes to begin underbalanced drilling, he will remove wear bushing 163 from lower sub 55. Upper sub 31 is then sealingly secured to the uppermost section of riser 11. BOP 19 (FIG. 1) and rotating BOP 21 are then secured to the upper connection of upper sub 31. Other drilling scenarios, such as that frequently used from a tension leg platform (TLP) or deep draft caisson vessel (DDCV) may require that upper sub 31 be an integral part of the drilling riser at all times. In such an event, wear bushing 39 is used to protect the sealing surfaces of upper sub 31 during conventional drilling operations.

The operator secures inner body 67 (FIG. 5) to the lower end of a string of inner riser 27, which is preferably made up of joints of casing. Seal sleeve 71 will be mounted to inner body 67 in the first position shown in FIG. 5. The operator lowers inner riser 27 into outer riser 11. Seal sleeve 71 has been positioned so that its shoulder 84 (FIG. 5) will contact lower landing shoulder 57 before casing hanger 43 (FIG. 3) lands on upper landing shoulder 33. This positioning is handled by making sure that the distance from shoulder 57 (FIG. 5) to shoulder 33 (FIG. 3) is less than the distance from seal sleeve shoulder 84 (FIG. 5) to shoulder 44 of casing hanger 43 (FIG. 3). When seal sleeve shoulder 84 lands on lower shoulder 57 (FIG. 5), casing hanger shoulder 44 (FIG. 3) will still be above upper landing shoulder 33.

Referring to FIG. 6, when shoulder 84 lands on shoulder 57, seal sleeve 71 cannot move any further downward. The operator continues to lower inner riser 27, the weight of which causes detent retaining ring 69 to release and allow downward movement of inner body 67 as shown in FIG. 6.

Pins 79 push lock ring 75 into groove 59. Seals 85 will seal against inlay 61, while seals 87 will seal to the outer diameter of inner body 67.

The downward movement of inner riser 27 continues until casing hanger shoulder 44 lands on upper landing shoulder 33 as shown in FIG. 3. The operator then installs packoff 47, which causes lock ring 45 to lock in groove 35. Seals 51 and 53 seal against the exterior of casing hanger 43 and the interior of upper sub 31.

The operator lowers drill pipe 25 (FIG. 1) through inner riser 27 into the well and begins rotating drill pipe 25 while rotating BOP 21 is closed around drill pipe 25. During drilling, the operator pumps a low density drilling fluid down drill pipe 25, which returns up annulus 89 and inner riser 27. The hydrostatic weight of the drilling fluid along the open hole portion of the well is preferably less than the earth formation pressure. The higher earth formation pressure is thus communicated to the drilling fluid as it returns up annulus 89 surrounding drill pipe 25 within inner riser 27. The positive drilling fluid pressure within annulus 89 communicates to outer riser 11 only below and above inner riser 27. The majority of outer riser 11 is isolated from the internal pressure within inner riser 27 because of lower seals 85, 87 (FIG. 6) and upper seals 51, 53 (FIG. 3).

Referring to FIG. 6, the pressure in drill pipe annulus 89 acts against a lower pressure area Ps of seal sleeve 71 that corresponds to the area of seal sleeve 71 between seals 85, 87. This pressure area results in an upward force that passes from seal sleeve 71 through lock ring 75 and into lower sub 55 of outer riser 11. There is no structure that will transmit any of the upward force applied on pressure area Ps to inner body 67 of inner riser 27. The upward force on seal sleeve 71 due to pressure in annulus 89 thus bypasses inner riser 27. If seal sleeve 71 were rigidly attached to inner body 67 and not latched to outer riser 11, the upward force applied to seal sleeve 71 would tend to force inner riser 27 upward and possibly cause it to buckle.

The invention has significant advantages. The inner riser allows underbalanced drilling with a conventional drilling riser. The independence of the seal sleeve from the inner riser avoids excessive upward force to the lower end of the inner riser due to pressure.

While the invention has been shown in only one of its forms, it should be apparent to those skilled in the art that it is not so limited but susceptible to various changes without departing from the scope of the invention.

The invention claimed is:

1. In a riser assembly for offshore drilling having a riser for fluid communication between a drilling platform and a subsea wellhead housing, the improvement comprising:

an inner conduit that is run into and suspended in the riser, defining an annular space between the inner conduit and the riser;

a seal assembly that seals the annular space at a point between a lower portion of the inner conduit and the riser, the seal assembly having a pressure area that is independent of the inner conduit so that any forces acting on the seal assembly due to pressure in the annular space below the seal assembly pass through the seal assembly to the riser and bypass the inner conduit; and wherein the seal assembly comprises a seal sleeve that is carried on the inner conduit for movement between a first position while running the inner conduit into the riser and an axially spaced second position after the inner conduit has landed in the riser.

2. The riser assembly according to claim 1, wherein the riser has an internal landing profile and the seal assembly comprises:

a seal sleeve having an outer profile that lands on the internal landing profile;

a latch member between the seal sleeve and the internal landing profile for releasably retaining the seal sleeve on the internal landing profile;

an outer seal between the seal sleeve and the riser;

an inner seal between the seal sleeve and the inner conduit; and wherein the seal sleeve is axially movable relative to the inner conduit.

3. The riser assembly according to claim 1, further comprising:

an internal upper landing profile in the riser; and an external landing shoulder on the inner conduit that lands on the upper landing profile.

4. The riser assembly according to claim 1, further comprising:

a packoff that seals between the riser and an upper portion of the inner conduit above the upper landing profile, thereby sealing an upper end of the annular space.

5. A riser assembly for offshore drilling, comprising:

an outer riser having a lower end for fluid communication with a subsea wellhead at an upper end of a well, the outer riser having an internal lower landing profile and an upper end for support by a drilling platform;

an inner riser that is lowered into and suspended within the outer riser for circulating drilling fluid between the well and the drilling platform;

a seal sleeve movably carried on a lower end of the inner riser while the inner riser is being lowered into the outer riser, the seal sleeve having an outer profile that lands on the lower landing profile;

an outer seal that seals between an outer diameter portion of the seal sleeve and an inner diameter portion of the outer riser; and an inner seal that seals between an inner diameter portion of the seal sleeve and an outer diameter portion of the inner riser.

6. The riser assembly according to claim 5, further comprising:

an internal upper landing profile in the outer riser;

an upper landing shoulder on the inner riser that lands on the upper landing profile;

an upper packoff that seals between the outer riser and the inner riser adjacent to the upper landing shoulder.

7. The riser assembly according to claim 5, further comprising:

a latch member between the seal sleeve and the outer riser, the latch member latching the seal sleeve to the outer riser.

8. The riser assembly according to claim 5, further comprising:

a split latch ring mounted to the seal sleeve; and a groove adjacent the lower landing profile that receives the latch ring to retain the seal member.

9. The riser assembly according to claim 5, wherein the seal sleeve has a first position relative to the inner riser while running the inner riser into the outer riser and a second position axially spaced from the first position after the seal sleeve lands on the lower landing profile.

10. The riser assembly according to claim 5, further comprising a retaining member for retaining the seal sleeve in the first position until the seal sleeve lands on the lower landing profile.

11. The riser assembly according to claim 5, wherein the seal sleeve has a pressure area that is independent of the inner riser so that any forces acting on the seal sleeve due to pressure below the seal sleeve pass through the seal sleeve to the outer riser and bypass the inner riser.

12. The riser assembly according to claim 5, wherein an annular space is located between the outer riser and the inner riser.

13. A riser assembly for offshore drilling, comprising:

an outer riser having internal upper and lower landing profiles;

an inner riser that is run into the outer riser and having an upper portion with an outer landing surface that lands on the internal upper landing profile;

a seal sleeve carried on a lower portion of the inner riser in a first position while running the inner riser into the outer riser, the seal sleeve having an outer profile that lands on the internal lower landing profile, the seal sleeve being spaced from the outer landing surface greater than a distance between the internal upper and lower landing profiles, causing the seal sleeve to land on the lower internal landing profile before the outer landing surface lands on the internal upper landing profile, the seal sleeve being movable relative to the inner riser, enabling the inner riser to move downward after the seal sleeve lands on the internal lower landing profile until the outer landing surface lands on the internal upper landing profile;

a latch that secures the seal sleeve to the internal lower landing profile;

an outer seal that seals between an outer diameter portion of the seal sleeve and an inner diameter portion of the outer riser;

an inner seal that seals between an inner diameter portion of the seal sleeve and an outer diameter portion of the inner riser; and a packoff located between the inner and outer risers above the internal upper landing profile.

14. The riser assembly according to claim 13, further comprising:

a subsea blowout preventer located at a lower end of the outer riser for connection to a subsea wellhead housing; and a rotating blowout preventer located at an upper end of the outer riser above the inner riser for sealing against drill pipe extending through the inner riser while the drill pipe rotates.

15. A method of isolating well fluid pressure from a portion of a drilling riser assembly extending between a drilling platform and a subsea wellhead housing:

(a) mounting a seal assembly to a lower portion of an inner conduit that has a pressure area that reacts independently of the inner conduit;

(b) lowering the inner conduit along with the seal assembly into the riser assembly and suspending the inner conduit in the riser assembly with the seal assembly above the wellhead housing; and (c) sealing between the inner conduit and the riser assembly with the seal assembly, thereby isolating pressure in the inner conduit from the riser, the independent pressure area of the seal assembly causing any forces acting on the seal assembly due to pressure below the seal assembly to pass through the seal assembly to the riser assembly and bypass the inner conduit.

16. The method according to claim 15, wherein step (a) comprises allowing axial movement of the inner conduit relative to the seal assembly.

17. The method according to claim 15, wherein:

step (b) comprises supporting the inner conduit on an internal landing profile in the riser assembly.

18. The method according to claim 15, further comprising:

providing internal upper and lower landing profiles in the riser assembly; and steps (b) and (c) comprise landing the seal assembly on the internal lower landing profile, then continuing to lower the inner conduit until landing the inner conduit on the internal upper landing profile.

19. A method of performing offshore drilling, comprising:

(a) providing a drilling riser assembly with internal upper and lower landing profiles, and suspending the drilling riser assembly between a drilling platform and a subsea wellhead housing;

(a) providing a seal sleeve with inner and outer seals and mounting the seal sleeve to a lower portion of an inner conduit;

(b) lowering the inner conduit in the riser assembly until the seal sleeve lands on the internal lower landing profile, then continuing to lower the inner conduit until an upper portion of the inner conduit lands on the internal upper landing profile, defining an annular space between the riser assembly and the inner conduit between the internal upper and lower landing profiles;

(c) sealing a lower portion of the annular space with the inner and outer seals;

(d) sealing an upper portion of the annular space with a packoff (d) lowering a drill string through the inner conduit and into the well;

(e) circulating drilling fluid down the drill string and back up the inner conduit around the drill string; and (f) sealing between the an upper end of the riser assembly and the drill string while performing step (e).

* * * * *